US006003317A

United States Patent [19]

Neubert

[11] Patent Number: 6,003,317

[45] Date of Patent: Dec. 21, 1999

[54] METHOD OF GENERATING SEALING STEAM FOR A STEAM TURBINE, STEAM POWER PLANT HAVING A STEAM TURBINE AND METHOD OF STARTING UP A STEAM TURBINE

[75] Inventor: Wolfgang Neubert, Steinbach, Germany

[73] Assignee: Siemens Aktiengesellschaft, Munich, Germany

[21] Appl. No.: 09/062,627

[22] Filed: Apr. 17, 1998

Related U.S. Application Data

[63] Continuation of application No. PCT/DE96/01927, Oct. 8, 1996.

[30] Foreign Application Priority Data

Oct. 17, 1995 [DE] Germany ..... 195 38 374

[51] Int. Cl.[6] ..... F01K 7/34

[52] U.S. Cl. ..... 60/653; 60/670

[58] Field of Search ..... 60/643, 645, 653, 60/670, 646

[56] References Cited

U.S. PATENT DOCUMENTS

| | | | |
|---|---|---|---|
| 4,474,010 | 10/1984 | Shibuya et al. | 60/645 X |
| 4,873,829 | 10/1989 | Williamson | 60/646 X |
| 5,095,706 | 3/1992 | Saito et al. | 60/646 |
| 5,412,936 | 5/1995 | Lee et al. | 60/646 X |

FOREIGN PATENT DOCUMENTS

| | | |
|---|---|---|
| 0 605 156 A2 | 7/1994 | European Pat. Off. . |
| 2 253 982 | 7/1975 | France . |
| 1 105 431 | 4/1961 | Germany . |
| 24 34 405 | 6/1975 | Germany . |
| 33 33 530 A1 | 4/1984 | Germany . |
| 367 520 | 4/1963 | Switzerland . |

*Primary Examiner*—Hoang Nguyen
*Attorney, Agent, or Firm*—Herbert L. Lerner; Laurence A. Greenberg

[57] ABSTRACT

A method of generating steam for a steam turbine includes extracting a first partial flow of saturated steam from a steam drum. The first partial flow of saturated steam is throttled and then superheated by heat exchange with a second partial flow of the saturated steam. A steam power plant includes a steam turbine having a water/steam cycle in which a steam drum is connected. A separate sealing-steam line leads from said steam drum to said steam turbine. A heat exchanger in said sealing-steam line has a primary side and a secondary side. The primary side is connected to said steam drum and a throttle member is connected between said secondary side and said steam drum. A method of starting a steam turbine of a steam power plant usees the sealing steam. The steam surbine is put at an especially low risk of corrosion even during restarting after shutdown.

3 Claims, 1 Drawing Sheet

METHOD OF GENERATING SEALING STEAM FOR A STEAM TURBINE, STEAM POWER PLANT HAVING A STEAM TURBINE AND METHOD OF STARTING UP A STEAM TURBINE

CROSS-REFERENCE TO RELATED APPLICATION

This application is a continuation of International Application No. PCT/DE96/01927, filed Oct. 8, 1996, which designated the United States.

BACKGROUND OF THE INVENTION

Field of the Invention

The invention relates to a method of generating sealing steam for a steam turbine, a steam power plant having a steam turbine and a method of starting up a steam turbine with sealing steam.

During an evaporation of water through the supply of heat, the water evaporates completely or partly. Steam which arises in that case is in thermal equilibrium with remaining water and is normally described as saturated steam. Such saturated steam may possibly contain considerable portions of water so that machine parts exposed to the saturated steam may sustain damage, for example in the form of corrosion. For that reason and/or for thermodynamic reasons, superheating of saturated steam is necessary during the utilization of steam as process steam in the chemical industry or as a working medium in a steam power plant. In order to superheat the saturated steam, it is normally first of all separated from the water before further heat is supplied to it.

In a steam power plant working according to the natural circulation principle, an evaporator disposed in a steam generator is normally connected to a steam drum on both the water and steam side. The water/steam mixture produced in the evaporator is fed to the steam drum, which serves to separate water and steam. From the steam drum, the water is again fed to the evaporator so that there is complete circulation. The steam is in equilibrium with the water in the steam drum and is therefore present as saturated steam. A useful-steam outlet is disposed at the steam drum in order to divert saturated steam obtained by evaporation, as useful steam. During operation of the steam power plant, the useful steam is normally fed to a superheater heating surface and is superheated there. The steam which is thus superheated is then fed to the steam turbine where it expands so as to perform work.

During a starting operation of the steam power plant, for example after a night shutdown, it is necessary to feed sealing steam to the steam turbine. The introduction of the sealing steam into a sealing region between the turbine shaft and the turbine casing ensures that the interior of the turbine is sealed off from the surroundings of the steam turbine. In that case, feeding of unsuperheated steam or saturated steam as sealing steam puts structural parts of the steam turbine at increased risk through corrosion or stress loading. Therefore, the feeding of superheated steam as sealing steam is necessary in particular for a steam power plant which is to be started again after frequent night shutdowns. However, the temperature level in the steam generator is often not sufficiently high in order to ensure sufficient steam superheating through the use of the superheater heating surfaces provided in the steam generator, especially during a starting operation after a night shutdown. The same or similar requirements are also often imposed on the process steam mentioned at the outset.

SUMMARY OF THE INVENTION

It is accordingly an object of the invention to provide a method of generating sealing steam for a steam turbine, a steam power plant having a steam turbine and a method of starting up a steam turbine, which overcome the hereinaforementioned disadvantages of the heretofore-known methods and devices of this general type in a simple and especially reliable manner.

With the foregoing and other objects in view there is provided, in accordance with the invention, a method of generating sealing steam for a steam turbine, which comprises extracting a first partial flow of saturated steam from a steam drum; throttling the first partial flow of saturated steam; and then superheating the first partial flow of saturated steam by heat exchange with a second partial flow of the saturated steam.

The invention starts out from the idea that superheated steam which is required, for example, as process steam in the chemical industry or as sealing steam when starting a steam turbine, can be at a lower pressure level than the saturated steam which is available. Therefore, it is possible to expand a first partial flow of the saturated steam, so that the first partial flow can be supplied for utilization. During this throttling of the first partial flow, its temperature level decreases. The temperature difference thus arising between the unthrottled saturated steam and the throttled first partial flow of the saturated steam may therefore be used to superheat the first partial flow.

The first partial flow is advantageously conducted through a controllable throttle valve so that the generated superheated steam can be adapted to process requirements with regard to its mass flow and its pressure level in an especially flexible manner.

In order to ensure an especially long service life of a steam turbine with simple measures even during frequent night shutdowns, the expanded and superheated first partial flow is expediently fed to a steam turbine. In addition, the saturated steam is advantageously extracted from a steam drum of the water/steam cycle of a steam turbine.

With regard to the configuration for generating superheated steam from saturated steam, a heat exchanger is connected on the primary side and through a throttle member on the secondary side to a saturated-steam reservoir.

In order to adapt the mass flow and/or the pressure level of the superheated steam to the process requirements, the throttle member is expediently a controllable throttle valve.

In a further expedient development, the heat exchanger is connected on the secondary side to a steam turbine. The saturated-steam reservoir is advantageously a steam drum connected in the water/steam cycle of a steam turbine.

With the objects of the invention in view there is also provided a steam power plant, comprising a steam turbine having a water/steam cycle; a steam drum connected in the water/steam cycle; a separate sealing-steam line leading from the steam drum to the steam turbine; a heat exchanger in the sealing-steam line, the heat exchanger having a primary side and a secondary side, the primary side connected to the steam drum; and a throttle member connected between the secondary side of the heat exchanger and the steam drum.

With the objects of the invention in view there is additionally provided a method of starting a steam turbine of a steam power plant, which comprises extracting a first partial flow of saturated steam from a steam drum; throttling the first partial flow of saturated steam; then superheating the first partial flow of saturated steam by heat exchange with a second partial flow of the saturated steam; and supplying the superheated first partial flow of saturated steam to a steam turbine as sealing steam for starting the steam turbine.

In order to ensure a long service life of a steam turbine with especially simple measures and in an especially reliable manner, the steam which is superheated according to the above-mentioned method is expediently used to seal off the steam turbine when the latter is being started.

The advantages achieved with the invention are in particular the fact that reliable generation of superheated steam with especially simple measures is ensured by the superheating of the expanded first partial flow of the saturated steam by heat exchange with a second partial flow of the saturated steam. In particular, in a steam power plant having frequent night shutdowns, a supply of superheated steam as sealing steam to the steam turbine is therefore ensured during restarting without an additional heating or superheating device being required.

Other features which are considered as characteristic for the invention are set forth in the appended claims.

Although the invention is illustrated and described herein as embodied in a method of generating sealing steam for a steam turbine, a steam power plant having a steam turbine and a method of starting up a steam turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The FIGURE of the drawing is a schematic circuit diagram of a steam power plant.

DESCRIPTION OF THE PREFERRED EMBODIMENTS

Figure 1:
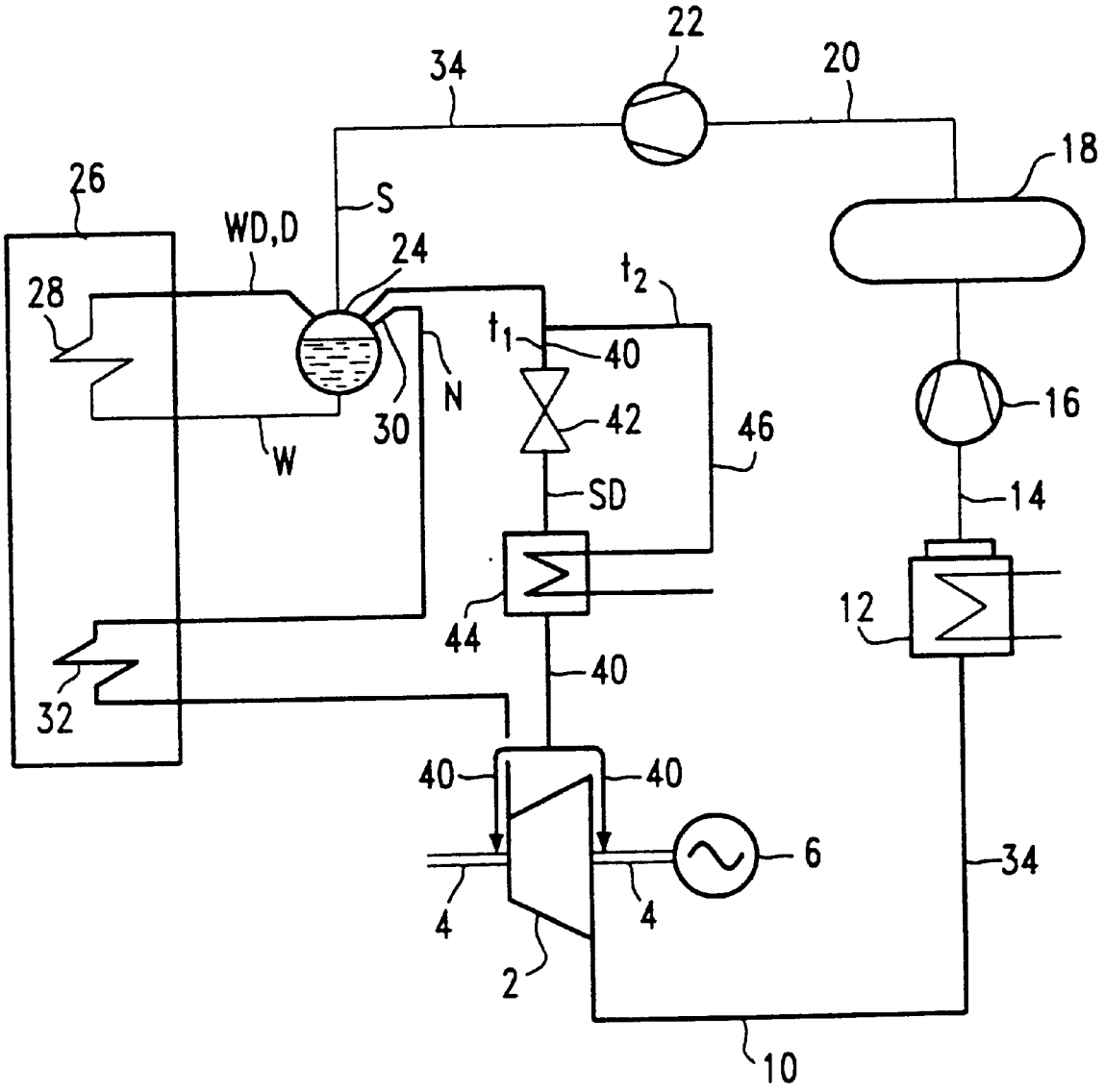

Referring now in detail to the single figure of the drawing, there is seen a steam power plant 1 which includes a steam turbine 2 that is connected by a turbine shaft 4 to a generator 6. The steam turbine 2 has an outlet side which is connected through a steam line 10 to a condenser 12. The condenser 12 is connected to a feedwater tank 18 through a line 14 in which a condensate pump 16 is connected. The feedwater tank 18 has an outlet side which is connected to a steam drum 24 through a feed line 20 in which a feedwater pump 22 is connected. A number of non-illustrated preheater heating surfaces or an economizer can be connected in the line 20 in order to preheat feedwater S to be fed to the steam drum 24.

The steam drum 24 has a water outlet side and a steam inlet side connected to an evaporator 28 disposed in a steam generator 26. In this case, the steam generator 26 may be a fossil-fired or nuclear-fired steam generator or even a waste-heat steam generator. Furthermore, a useful-steam outlet 30 disposed at the steam drum 24 is connected through a superheater 32 disposed in the steam generator 26 to the steam turbine 2.

The steam turbine 2 may include one or more pressure stages. Further heating surfaces in addition to the heating surfaces 28 and 32 shown in the figure may be provided, depending on the number of pressure stages and depending on the layout of a water/steam cycle 34 of the steam turbine 2.

Sealing steam SD can be fed to the steam turbine 2 through a sealing-steam line 40 connected to the steam drum 24. A throttle member 42 that is constructed as a controllable throttle valve is connected in the sealing-steam line 40. A heat exchanger 44 which is disposed downstream of the throttle member 42, as viewed in the direction of flow of the sealing steam SD, has a secondary side connected in the sealing-steam line 40. The heat exchanger 44 has a primary side which is connected to the steam drum 24 through a partial-flow line 46 branching off from the sealing-steam line 40.

During operation of the steam power plant 1, water W which is fed from the steam drum 24 to the evaporator 28 is completely or partly evaporated there and is fed back as steam D or as a water/steam mixture WD into the steam drum 24. The steam D is separated from the water W in the steam drum 24. The steam D is in thermodynamic equilibrium with the water W in the steam drum 24 and is therefore present as saturated steam.

Hot useful steam N under positive pressure can be extracted from the steam drum 24 and fed through the superheater 32 to the steam turbine 2, where it expands so as to perform work.

In order to ensure that the turbine interior of the steam turbine 2 is sealed off from its surroundings, the sealing steam SD is fed to a region between the turbine shaft 4 and a casing of the steam turbine 2, in particular during a starting operation. To this end, a first partial flow $t_1$ of steam D that is present as saturated steam is extracted from the steam drum 24 serving as a saturated-steam reservoir. The partial flow $t_1$ is throttled through the controllable throttle valve or throttle member 42 in such a way that its pressure level is adapted to the requirements of the steam turbine 2. The temperature level of the partial flow $t_1$ decreases due to the throttling. A second partial flow $t_2$ of the steam D that is present as saturated steam is conducted in the partial-flow line 46, is unthrottled and is therefore at a higher temperature than the first partial flow $t_1$ which is throttled in the throttle member 42. The partial flow $t_1$ is superheated by a heat exchange of the unthrottled second partial flow $t_2$ with the throttled first partial flow $t_1$ in the heat exchanger 44. This superheated partial flow $t_1$ can then be fed as sealing steam SD to the steam turbine 2 without the latter being put at risk through corrosion.

The steam power plant 1 is therefore especially suitable for frequent restarting of the steam turbine 2, in particular after a night shutdown. After a night shutdown, the steam D which is present as saturated steam in the steam drum 24 is at a temperature of about 210° C. Due to pressure and temperature losses in piping and due to the throttling by the throttling member 42, the partial flow $t_1$ is at a temperature of about 150° C. after its throttling. This temperature can be increased to about 180° C. by heat exchange with the unthrottled partial flow $t_2$, without an additional superheater device being required for this purpose. The superheating of the partial flow $t_1$ is therefore ensured with especially simple measures and in an especially reliable manner.

I claim:

1. A method of generating sealing steam for a steam turbine, which comprises:

extracting a first partial flow of saturated steam from a steam drum;

throttling the first partial flow of saturated steam; and then superheating the first partial flow of saturated steam by heat exchange with a second partial flow of the saturated steam.

2. A steam power plant, comprising:

a steam turbine having a water/steam cycle;

a steam drum connected in said water/steam cycle;

a separate sealing-steam line leading from said steam drum to said steam turbine;

a heat exchanger in said sealing-steam line, said heat exchanger having a primary side and a secondary side, said primary side connected to said steam drum; and a throttle member connected between said secondary side of said heat exchanger and said steam drum.

3. A method of starting a steam turbine of a steam power plant, which comprises:

extracting a first partial flow of saturated steam from a steam drum;

throttling the first partial flow of saturated steam;

then superheating the first partial flow of saturated steam by heat exchange with a second partial flow of the saturated steam; and supplying the superheated first partial flow of saturated steam to a steam turbine as sealing steam for starting the steam turbine.

* * * * *